US007716957B2

(12) United States Patent
Ha et al.

(10) Patent No.: US 7,716,957 B2
(45) Date of Patent: May 18, 2010

(54) DRUM TYPE WASHING MACHINE WITH DOOR RING

(75) Inventors: Young Hoon Ha, Masan-si (KR); Bo Yoen Kim, Changwon-si (KR); Jong Seog Gim, Changwon-si (KR); Ji Chang Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 11/257,068

(22) Filed: Oct. 25, 2005

(65) Prior Publication Data

US 2006/0117809 A1 Jun. 8, 2006

Related U.S. Application Data

(63) Continuation-in-part of application No. 10/992,673, filed on Nov. 22, 2004.

(30) Foreign Application Priority Data

Dec. 30, 2003 (KR) ..... 10-2003-0100251
Dec. 30, 2003 (KR) ..... 10-2003-0100252
Dec. 30, 2003 (KR) ..... 10-2003-0100253
Dec. 30, 2003 (KR) ..... 10-2003-0100254
Dec. 30, 2003 (KR) ..... 10-2003-0100255

(51) Int. Cl.
*D06F 39/14* (2006.01)

(52) U.S. Cl. ..... 68/196

(58) Field of Classification Search ..... 68/24, 68/140, 196
See application file for complete search history.

(56) References Cited

U.S. PATENT DOCUMENTS 2,105,248 A * 1/1938 Johnson ..... 68/139
2,200,144 A * 5/1940 Zimarik ..... 68/58
2,204,551 A * 6/1940 Place ..... 49/377
2,313,152 A * 3/1943 Jorgenson ..... 68/144
2,317,213 A * 4/1943 Oliver ..... 220/849
2,843,945 A * 7/1958 Whyte ..... 34/82
2,861,355 A * 11/1958 Douglas ..... 34/82
3,069,887 A * 12/1962 Gonld ..... 68/23.5

(Continued)

FOREIGN PATENT DOCUMENTS

DE 2 439 254 * 5/1980

(Continued)

OTHER PUBLICATIONS

European Patent Office 1 291 459 Mar. 2003.*

(Continued)

*Primary Examiner*—Frankie L Stinson
(74) *Attorney, Agent, or Firm*—Birch, Stewart, Kolasch & Birch, LLP

(57) ABSTRACT

Disclosed herein is a drum type washing machine with a door ring. A front member is attached to the front surface of a door frame to increase the strength of a door. A decorative part is formed either at the door frame or at the front member of the door frame to improve the appearance of the door. The door ring is mounted at a cabinet around the door. Consequently, the strength of a structure around the door is increased while the appearance of the front surface of the washing machine is improved.

20 Claims, 9 Drawing Sheets

U.S. PATENT DOCUMENTS

| | | | | | |
|---|---|---|---|---|---|
| 3,139,784 | A | * | 7/1964 | Moorman | 411/510 |
| 3,370,738 | A | * | 2/1968 | Kesling | 220/592.06 |
| 4,564,557 | A | | 1/1986 | Ohgushi et al. | |
| 5,496,104 | A | * | 3/1996 | Arnold et al. | 312/204 |
| 6,736,470 | B2 | | 5/2004 | Manke et al. | |
| 6,840,773 | B2 | | 1/2005 | Anderson et al. | |
| D515,260 | S | | 2/2006 | Ha et al. | |
| 7,032,350 | B2 | * | 4/2006 | Bienick et al. | 49/501 |
| 7,299,666 | B2 | | 11/2007 | Geyer et al. | |

FOREIGN PATENT DOCUMENTS

| | | | | |
|---|---|---|---|---|
| DE | 34 40 899 | | * | 4/1986 |
| EP | 195 15 040 | | * | 10/1996 |
| GB | 2 114 432 | A | | 8/1983 |
| JP | 62-97836 | | * | 5/1987 |
| JP | 04-174152 | A | | 6/1992 |
| JP | 08-281429 | A | | 10/1996 |
| JP | 11-244575 | A | | 9/1999 |
| JP | 11-300888 | A | | 11/1999 |
| JP | 200-15658 | | * | 1/2000 |
| JP | 2001-207648 | | * | 8/2001 |
| JP | 2001-277290 | A | | 10/2001 |
| JP | 2002-010892 | A | | 1/2002 |
| JP | 2002-098776 | A | | 4/2002 |
| JP | 2003-175298 | A | | 6/2003 |
| JP | 2003-291261 | A | | 10/2003 |
| JP | 2004-224945 | A | | 8/2004 |
| WO | WO-02/14593 | A2 | | 2/2002 |

OTHER PUBLICATIONS

European Patent Office 1 291 459 Sep. 2002.*

* cited by examiner

DRUM TYPE WASHING MACHINE WITH DOOR RING

This application is a Continuation-In-Part of application Ser. No. 10/992,673 filed on Nov. 22, 2004, the entire contents of which are hereby incorporated by reference and for which priority is claimed under 35 U.S.C. § 120.

BACKGROUND OF THE INVENTION

1. Field of the Invention

The present invention relates to a drum type washing machine, and, more particularly, to a drum type washing machine having a door ring mounted at a cabinet around a door for increasing the strength of the cabinet while improving the appearance of a structure around the door.

2. Description of the Related Art

Generally, a washing machine is a machine that is capable of removing pollutants from laundry through mechanical actions carried out by electric power. A drum type washing machine is a kind of washing machine. The drum type washing machine performs a washing operation using friction between a horizontally-mounted drum, which is rotated by a driving force of a motor, and laundry put in the drum under the condition that detergent and wash water are also put in the drum. The drum type washing machine has various effects in that damage to the laundry is minimized, the laundry is not entangled, and the laundry is struck and rubbed.

FIG. 1 is a perspective view showing a conventional drum type washing machine, FIG. 2 is a sectional side view of the conventional drum type washing machine, and FIG. 3 is a cross-sectional view of the conventional drum type washing machine seen from line A-A of FIG. 2.

As shown in FIGS. 1 and 2, the conventional drum type washing machine comprises: a cabinet 2 forming the external appearance of the washing machine; a tub 4 mounted in the cabinet while being suspended by a spring 3; a drum 5 mounted in the tub 4 for receiving laundry; lifters 6 attached to the inner side surface of the drum 5 for lifting the laundry to a predetermined height such that the laundry falls due to gravity from the predetermined height; a motor 7 mounted at the rear of the tub 4 for generating a rotating force; a cabinet cover 17 mounted at the front of the cabinet 2, the cabinet cover 17 having a laundry inlet/outlet hole 18 formed at the center thereof for allowing laundry to be put into or removed from the drum 5 therethrough; and a door 20 hingedly connected to the cabinet cover 17 for closing the laundry inlet/outlet hole 18 to prevent the laundry from being removed from the drum 5 through the laundry inlet/outlet hole 18.

Between the tub 4 and the door 20 is mounted a gasket 8 for diminishing impacts generated when the drum 5 is rotated. Also, the gasket 8 serves as a packing for preventing wash water from leaking from the tub 4.

At the top and bottom parts of the drum type washing machine are mounted a top plate 9, which forms a top surface of the washing machine, and a base 10, which forms a bottom surface of the washing machine, respectively. Under the tub 4 are mounted a draining pump 11 and a draining hose 12, which are used to circulate or drain the wash water. Under the top plate 9 are mounted a water supply hose 13 and a water supply valve 14, which are used to supply wash water into the tub 4, and a detergent box 15, which is used to supply detergent into the tub 4.

Referring to FIG. 3, the door 20 of the conventional drum type washing machine comprises: a ring-shaped door frame 21 hingedly connected to the cabinet cover 17; a door hinge 24, having opposite ends mounted at the door frame 21 and the cabinet cover 17, respectively, for hingedly supporting the door frame 21; and a door glass 25 mounted at an open center hole 21*a* formed at the door frame 21 for allowing a user to look into the drum 5 therethrough.

The door frame 21 is a common injection-molded plastic member. The door frame 21 comprises: a front door frame 22 forming the front part of the door frame 21, the front door frame 22 having a grip 29 formed at one side thereof; and a rear door frame 23 disposed at the rear of the front door frame 22 for forming the rear part of the door frame 21. One end of the door hinge 24 is mounted at the rear door frame 23. From one side of the rear door frame 23 is protruded a hook 27, and the cabinet cover 17 has a hook hole 28, into which the hook 27 is engaged.

The edge of the door glass 25 is fixed between the front door frame 22 and the rear door frame 23 such that the center hole 21*a* of the door frame 21 is sealed.

Recently, design of products has been increasingly focused on marketability in addition to performance and durability of the products. For this reason, appearance, color, and texture of new products are carefully considered, when the products are developed, to satisfy aesthetic desires of consumers.

In the conventional drum type washing machine, however, the door frame 21 is the injection-molded plastic member as described above. As a result, the conventional drum type washing machine does not have a luxurious appearance, and therefore, the marketability of the conventional drum type washing machine is lowered.

In addition, drum type washing machines have become increasingly large. In this case, the sizes of the laundry inlet/outlet hole 18 and the door 20 are increased. Consequently, it is necessary that the door frame 21 have sufficient strength to support load of the enlarged door glass 25. However, the door frame 21 is the injection-molded plastic member, and therefore, it is difficult to increase the strength of the door frame 21.

In order to solve the above-mentioned problem and to provide the drum type washing machine with a luxurious appearance, the door frame 21 may be made of a metallic material having excellent strength. In this case, however, the material costs are increased, the total weight of the door is increased, and surface treatment for texture improvement is very difficult.

The door 20 is hingedly connected to the cabinet cover 17, which constitutes the cabinet 2, such that the door 20 can be opened or closed. However, no additional reinforcing member is disposed around the laundry inlet/outlet hole 18 of the cabinet cover 17. Consequently, the large-sized door 20 is not sufficiently supported by the cabinet cover 17 of the conventional drum type washing machine.

Furthermore, the front surface of the cabinet cover 17 is formed in a single plane structure, and therefore, improvement in appearance of the front part of the drum type washing machine is limited.

SUMMARY OF THE INVENTION

Therefore, the present invention has been made in view of the above problems, and it is an object of the present invention to provide a drum type washing machine having a door ring mounted around a door for increasing the strength of a structure around the door while providing the drum type washing machine with a more pleasing appearance.

It is another object of the present invention to provide a drum type washing machine having a front member attached to a door frame for increasing the strength of the door frame, the front member being easily and conveniently replaced if necessary.

It is yet another object of the present invention to provide a drum type washing machine having a decorative part disposed at the front surface of a door frame or a front member for improving the overall appearance of the door.

In accordance with one aspect of the present invention, the above and other objects can be accomplished by the provision of a drum type washing machine comprising: a door including a door frame hingedly connected to a cabinet, a door glass supported by the door frame, and a front member attached to the front surface of the door frame; and a door ring mounted at the cabinet cover, the door ring being disposed along the outer circumference of the door.

Preferably, the door is formed in the shape of a circle, and the door ring is formed in the shape of a circular ring.

Preferably, the door ring is convexly protruded outward from the cabinet.

Preferably, the door ring has a plating layer formed at the outer surface thereof.

Preferably, the door ring is formed by injection molding.

Preferably, the door ring is securely fixed to the cabinet.

Preferably, the door ring has fixing members, which are formed in the shape of a hook, the fixing members being inserted in fixing holes formed at the cabinet, respectively. Alternatively, the door ring may be securely attached to the cabinet by means of an adhesive member.

Also preferably, the door ring is integrally formed at the cabinet by bending the cabinet.

According to the present invention, the front member is attached to the front surface of the door frame. Consequently, the strength of the door frame is considerably increased without forming the door frame of a metallic material or another special material.

In accordance with another aspect of the present invention, there is provided a drum type washing machine comprising: a door including a door frame hingedly connected to a cabinet, a door glass supported by the door frame, and a decorative part disposed at the front surface of the door frame; and a door ring mounted at the cabinet cover, the door ring being disposed along the outer circumference of the door.

Preferably, the door is formed in the shape of a circle, and the door ring is formed in the shape of a circular ring.

Preferably, the door ring is convexly protruded outward from the cabinet.

Preferably, the door ring has a plating layer formed at the outer surface thereof.

Preferably, the door ring is formed by injection molding.

Preferably, the door ring is securely fixed to the cabinet.

Preferably, the door ring has fixing members, which are formed in the shape of a hook, the fixing members being inserted in fixing holes formed at the cabinet, respectively. Alternatively, the door ring may be securely attached to the cabinet by means of an adhesive member.

Also preferably, the door ring is integrally formed at the cabinet by bending the cabinet.

According to the present invention, the decorative part is formed at the front member of the door frame or is directly formed at the door frame. Consequently, the appearance of the door is improved.

In accordance with yet another aspect of the present invention, there is provided a drum type washing machine comprising: a door including a door frame hingedly connected to a cabinet and a door glass supported by the door frame; and a door ring mounted at the cabinet cover, the door ring being disposed along the outer circumference of the door.

Preferably, the door is formed in the shape of a circle, and the door ring is formed in the shape of a circular ring. Also preferably, the door ring is convexly protruded outward from the cabinet.

Preferably, the door ring is formed by injection molding, and the door ring has a plating layer formed at the outer surface thereof.

Preferably, the door ring is securely fixed to the cabinet.

Preferably, the door ring has fixing members, which are formed in the shape of a hook, the fixing members being inserted in fixing holes formed at the cabinet, respectively. Alternatively, the door ring may be securely attached to the cabinet by means of an adhesive member.

Also preferably, the door ring is integrally formed at the cabinet by bending the cabinet.

According to the present invention, the door ring is mounted at the cabinet around the door. Consequently, the strength of a structure around the door is increased while the appearance of the front surface of the washing machine is improved.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
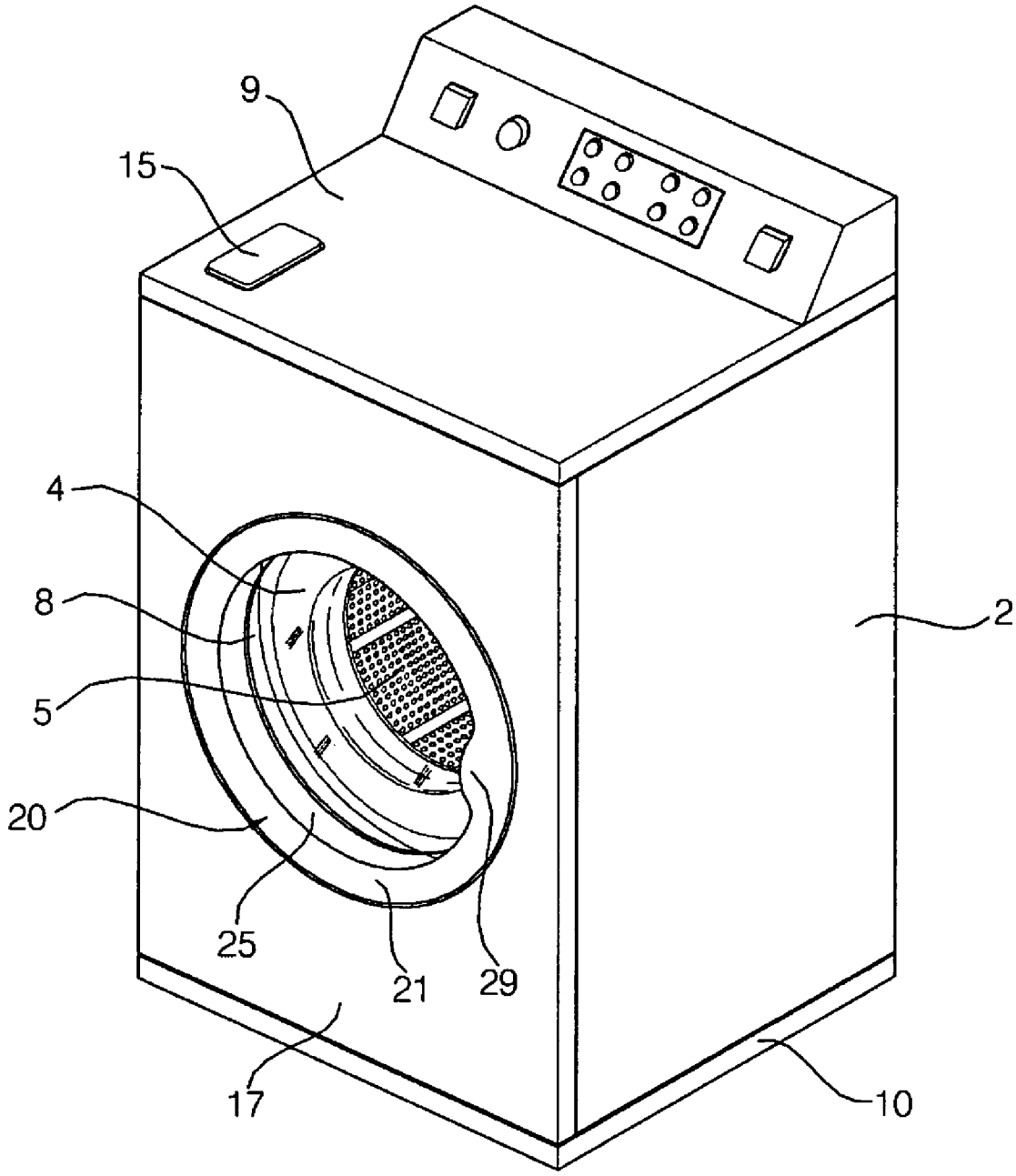
FIG. 1 (Prior Art)
FIG. 1 is a perspective view showing a conventional drum type washing machine.
Figure 2:
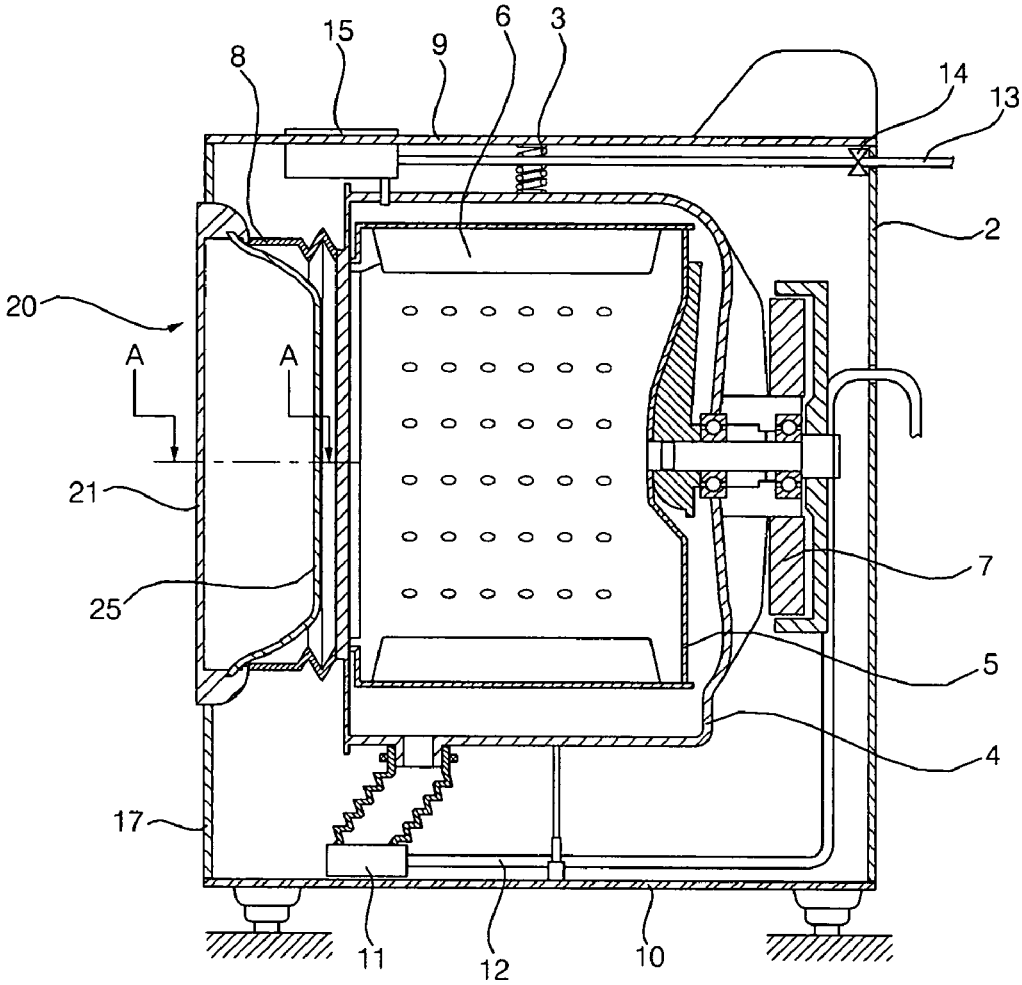
FIG. 2 (Prior Art)
FIG. 2 is a sectional side view of the conventional drum type washing machine.
Figure 3:
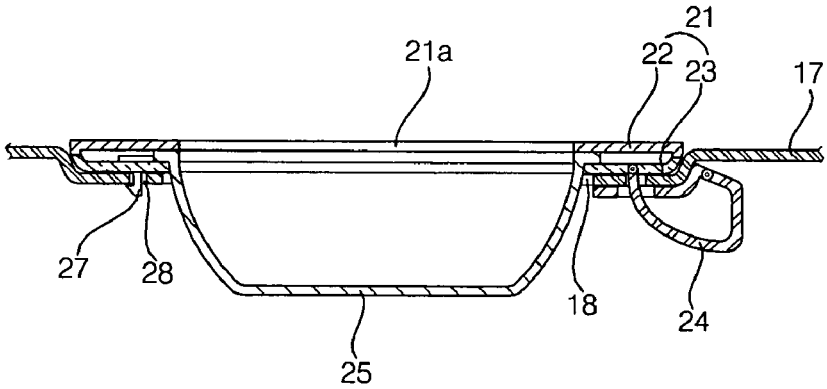
FIG. 3 (Prior Art)
FIG. 3 is a cross-sectional view of the conventional drum type washing machine seen from line A-A of FIG. 2.
Figure 4:
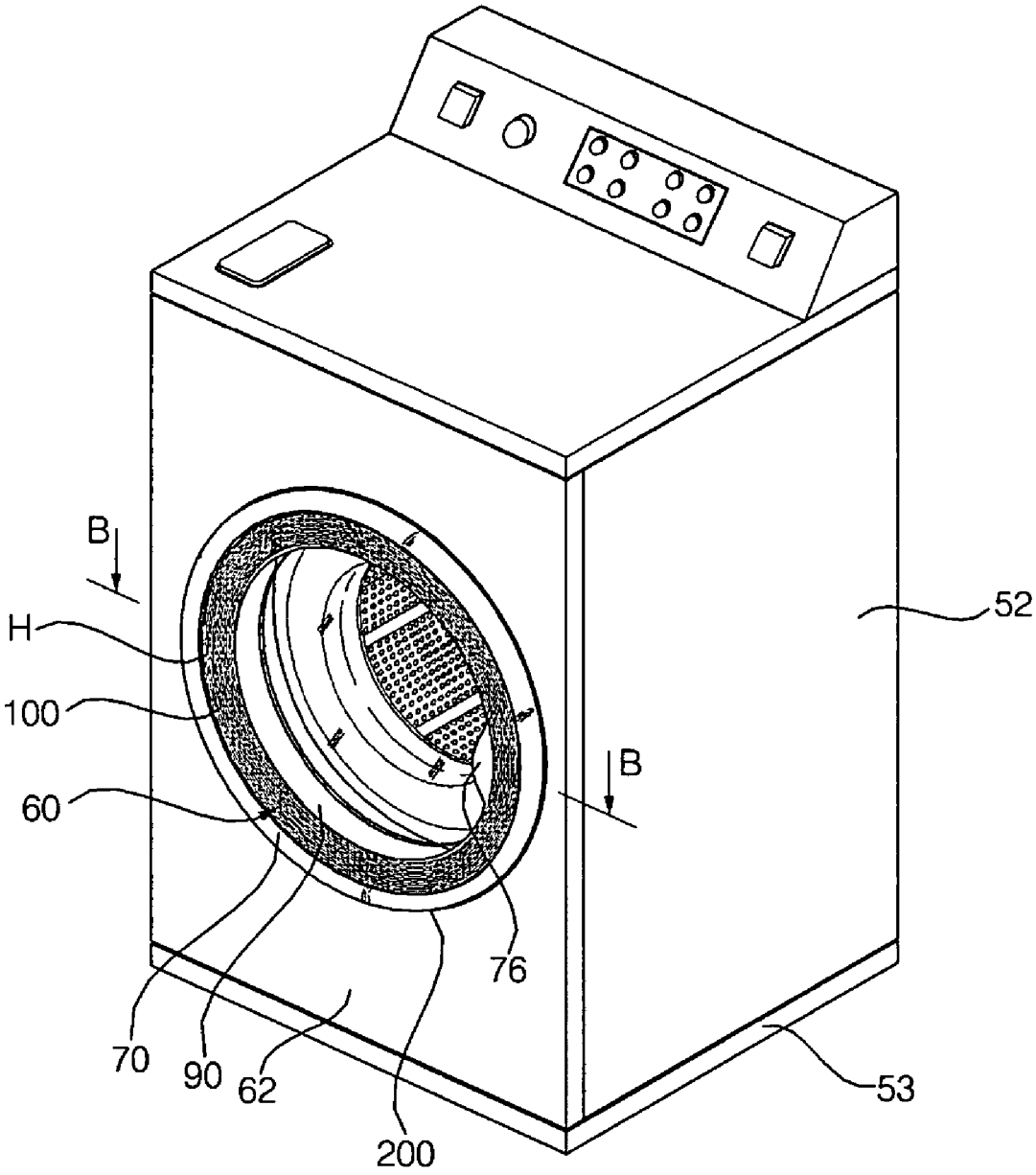
FIG. 4 is a perspective view showing a drum type washing machine with a door ring according to a first preferred embodiment of the present invention.
Figure 5:
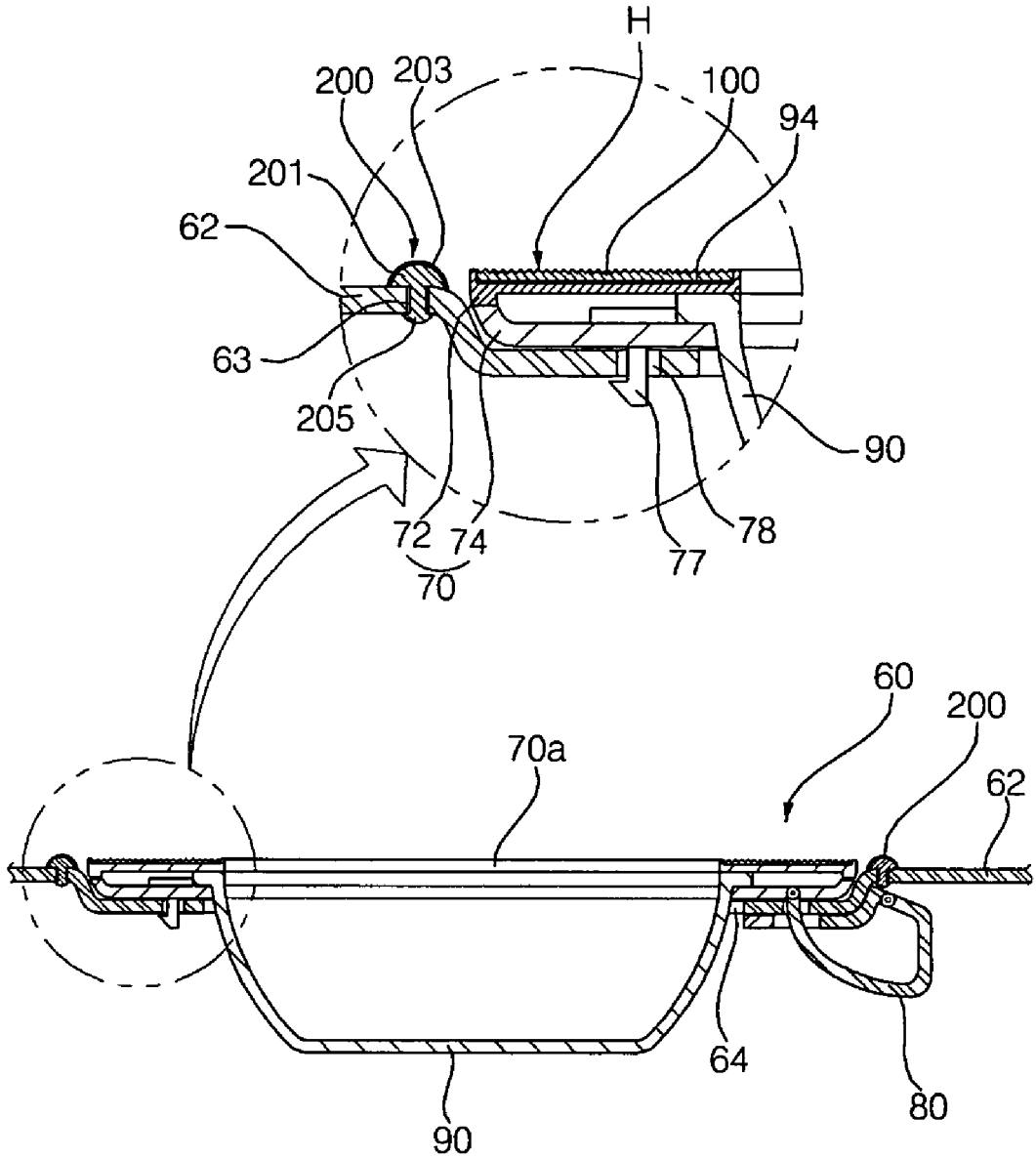
FIG. 5 is a cross-sectional view of the drum type washing machine according to the first preferred embodiment of the present invention seen from line B-B of FIG. 4.
Figure 6:
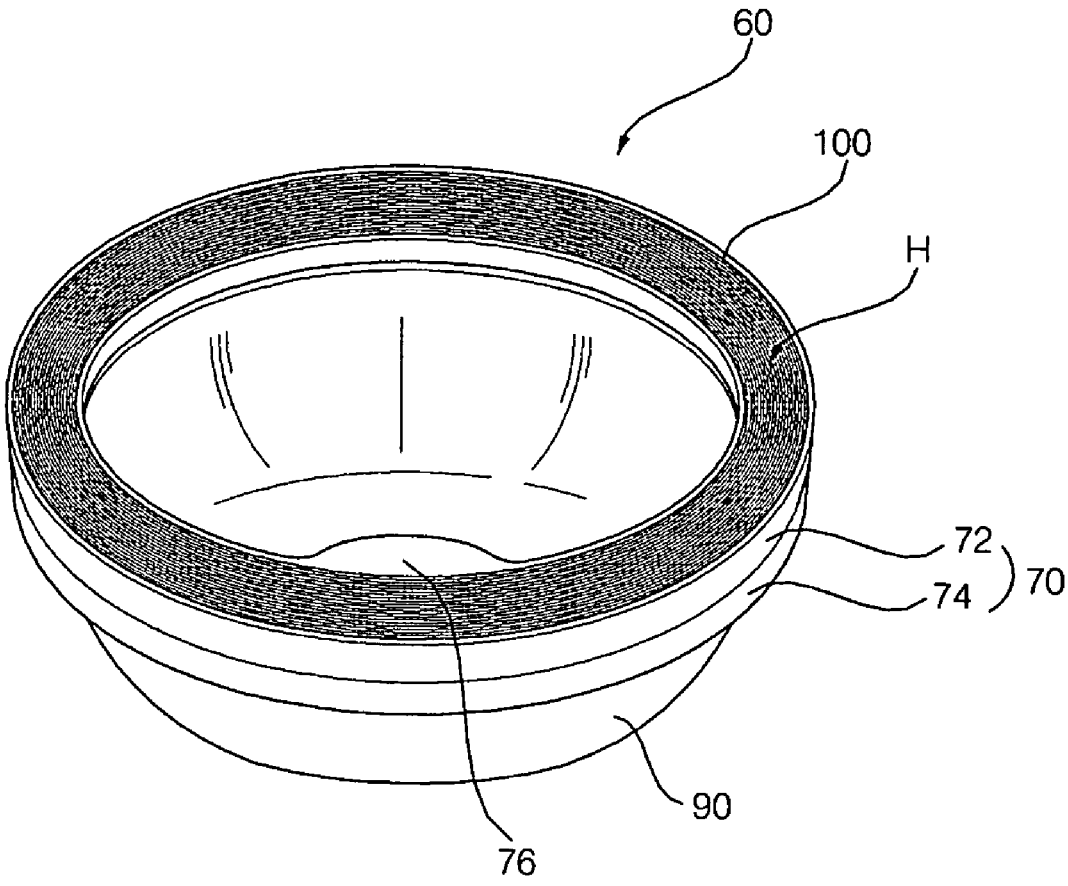
FIG. 6 is a perspective view showing a door of the drum type washing machine according to the first preferred embodiment of the present invention.
Figure 7:
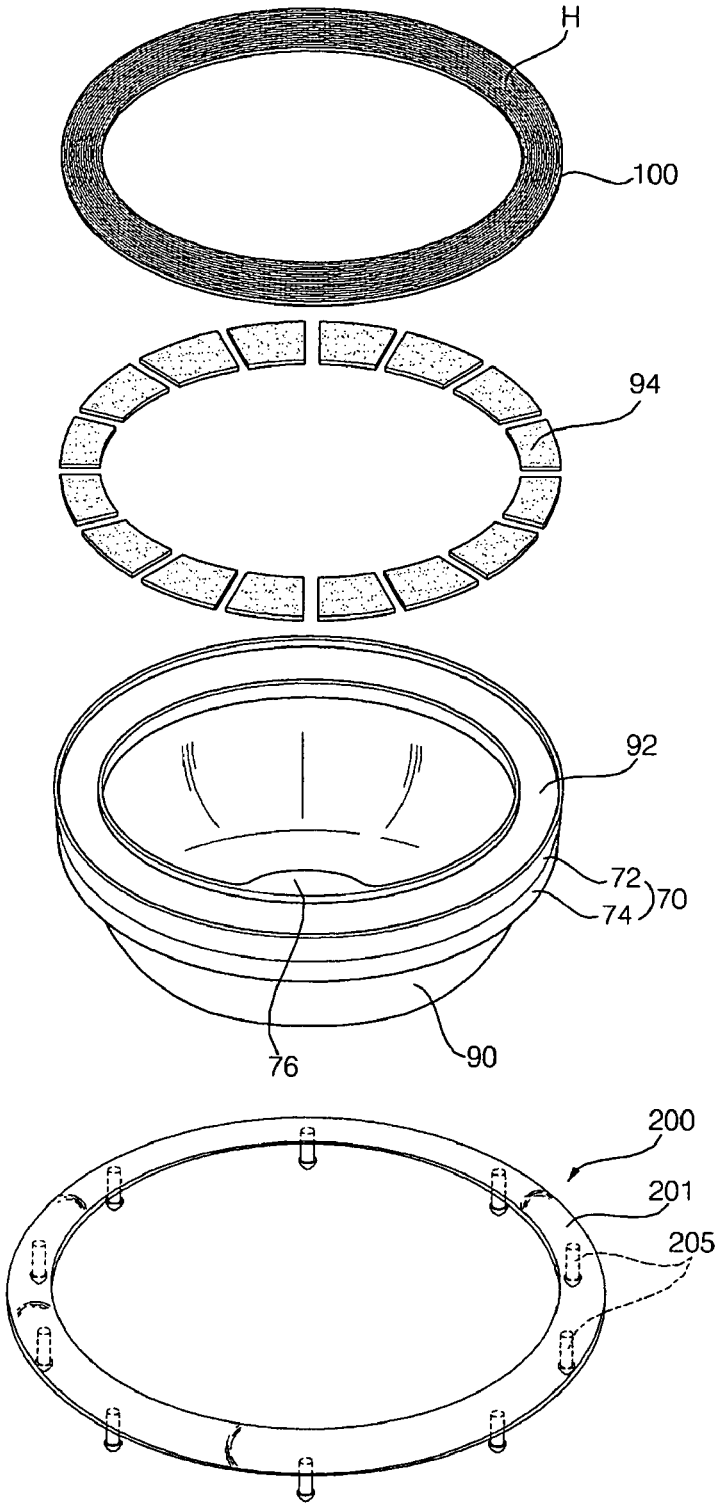
FIG. 7 is an exploded perspective view showing the door and the door ring of the drum type washing machine according to the first preferred embodiment of the present invention.

FIG. 4 is a perspective view showing a drum type washing machine with a door ring according to a first preferred embodiment of the present invention, FIG. 5 is a cross-sectional view of the drum type washing machine according to the first preferred embodiment of the present invention seen from line B-B of FIG. 4, FIG. 6 is a perspective view showing a door of the drum type washing machine according to the first preferred embodiment of the present invention, and FIG. 7 is an exploded perspective view showing the door and the door ring of the drum type washing machine according to the first preferred embodiment of the present invention.

As shown in FIGS. 4 to 7, the drum type washing machine according to the first preferred embodiment of the present invention has a door 60 hingedly connected to a cabinet cover 62, which forms the front surface of a cabinet 52, for opening and closing a laundry inlet/outlet hole 64. At the cabinet cover 62 is mounted a door ring 200, which is disposed along the outer circumference of the door 60.

Reference numeral 53 in FIG. 4 indicates a base for supporting the cabinet 52.

The door 60 and the door ring 200 of the drum type washing machine according to the first preferred embodiment of the present invention will be described hereinafter in detail with reference to the accompanying drawings.

Referring to FIGS. 5 to 7, the door 60 comprises: a ring-shaped door frame 70 hingedly connected to the cabinet cover 62, at which the laundry inlet/outlet hole 64 is formed; a door hinge 80, having opposite ends mounted at the door frame 70 and the cabinet cover 62, respectively, for hingedly supporting the door frame 70; a door glass 90 mounted at an open center hole 70*a* formed at the door frame 70 for allowing a user to look into a drum (not shown) therethrough; and a front member 100 attached to the front surface of the door frame 70 for providing the door 60 with a luxurious texture or increasing the strength of the door 60. Preferably, the front member 100 has a sheet structure.

The door frame 70 comprises: a front door frame 72 forming the front part of the door frame 70, the front door frame 72 having a grip 76 formed at one side thereof; and a rear door frame 74 disposed at the rear of the front door frame 72 for forming the rear part of the door frame 70. One end of the door hinge 80 is mounted at the rear door frame 74.

From one side of the rear surface of the rear door frame 74 is protruded a hook 77, and the cabinet cover 62 has a hook hole 78, which corresponds to the hook 77. The door 60 is held at the laundry inlet/outlet hole 64 by securely engaging the hook 77 into the hook hole 78.

Preferably, the front door frame 72 and the rear door frame 74 are made of a nonmetallic material, which is light and has excellent injection moldability, such as plastic.

The edge of the door glass 90 is disposed between the front door frame 72 and the rear door frame 74. The center hole 70*a* of the door frame 70 is sealed by coupling the front door frame 72 with the rear door frame 74.

The front member 100 has a decorative part, which provides a luxurious texture to the front surface of the front member 100. The decorative part consists of multiple ring-shaped hairlines H. The front member 100 is securely fitted in a fitting groove 92 formed at the front surface of the door frame 70.

Specifically, the fitting groove 92, in which the front member 100 is fitted, is formed at the front surface of the front door frame 72. The fitting groove 92 is disposed along the front door frame 72 in a ring-shaped structure.

The front member 100 is a ring-shaped thin panel. The front member 100 is made of stainless steel. The decorative part, which consists of multiple ring-shaped hairlines H, is formed at the front surface of the front member 100 to provide a luxurious texture to the front member 100.

The front member 100 may be cut from a stainless steel plate in the shape of a single ring. Alternatively, a plurality of ring pieces may be cut from the stainless steel plate, and then, the ring pieces may be connected to one another to form the front member 100.

The multiple hairlines H are very thin lines obtained by scratching the front surface of the front member 100 with a sharp tool. The multiple hairlines H are coaxially formed at the ring-shaped front member 100.

The front member 100 is forcibly fitted in the fitting groove 92 of the front door frame 72. For this reason, the front member 100 is manufactured such that the front member 100 can be forcibly fitted in the fitting groove 92.

Preferably, the front member 100 is securely fixed in the fitting groove 92 of the front door frame 72 by means of an adhesive member 94.

The adhesive member 94 may be a bonding agent or a double-sided adhesive tape. The adhesive member 94 is applied to the bottom surface of the fitting groove 92 before the front member 100 is fitted into the fitting groove 92. When the front member 100 is fitted into the fitting groove 92, the front member 100 is fixedly attached to the bottom surface of the fitting groove 92 by the adhesive member 94. As a result, the front member is securely fixed in the fitting groove 92.

Consequently, the strength of the door 60 is increased by virtue of the front member 100, which is made of a metallic material, and the door 60 has a luxurious texture by virtue of the hairlines H of the front member 100. At this time, the surface of the front door frame 72 is preferably plated with a material or color similar to the front member 100 to improve the appearance of the door 60.

The door ring 200 is formed in the shape of a circular ring. The door ring 200 is mounted at the cabinet cover 62 around the door 60 while being convexly protruded outward from the front surface of the cabinet cover 62.

Specifically, the door ring 200 has a ring body 201, which is convexly protruded to have a semicircular section.

At the cabinet cover 62 are formed a plurality of fixing holes 63, which are disposed around the door 60 at a predetermined interval. Correspondingly, the door ring 200 is provided at the rear surface of the ring body 201 with a plurality of fixing members 205, which are formed in the shape of a hook. The fixing members 205 are disposed in a predetermined interval such that the fixing members 205 can be inserted in the fixing holes 63 of the cabinet cover 62, respectively.

The door ring 200 is securely fixed to the cabinet cover 62 by inserting the fixing members 205 into the corresponding fixing holes 63 of the cabinet cover 62.

Preferably, the door ring 200 is made of an injection-molded synthetic resin material. A plating layer 203, such as a metal plating layer, is formed at the surface of the door ring 200.

Preferably, the ring body 201 and the fixing members 205 of the door ring 200 may be integrally formed of the same material. Alternatively, the ring body 201 and the fixing members 205 of the door ring 200 may be separately manufactured, and then, the fixing member 205 may be securely fixed to the ring body 201 by means of various fixing units.

The plating layer 203 may be formed in the same color as or a contrasting color as the cabinet cover 62 or the decorative part 100 of the door 60.

After the door ring 200 is mounted around the door 60, the door ring 200 improves the appearance of the door of the washing machine and its circumference together with the decorative part 100 of the door 60. Consequently, the whole pleasing appearance of the washing machine is accomplished.

Furthermore, the door ring 200 is additionally mounted at the cabinet cover 62, which is usually made of a steel plate, around the laundry inlet/outlet hole 64, to which load is significantly applied due to the door 60, and therefore, the cabinet cover 62 has strength sufficient to support the door although the capacity of the washing machine is largely increased.

Figure 8:
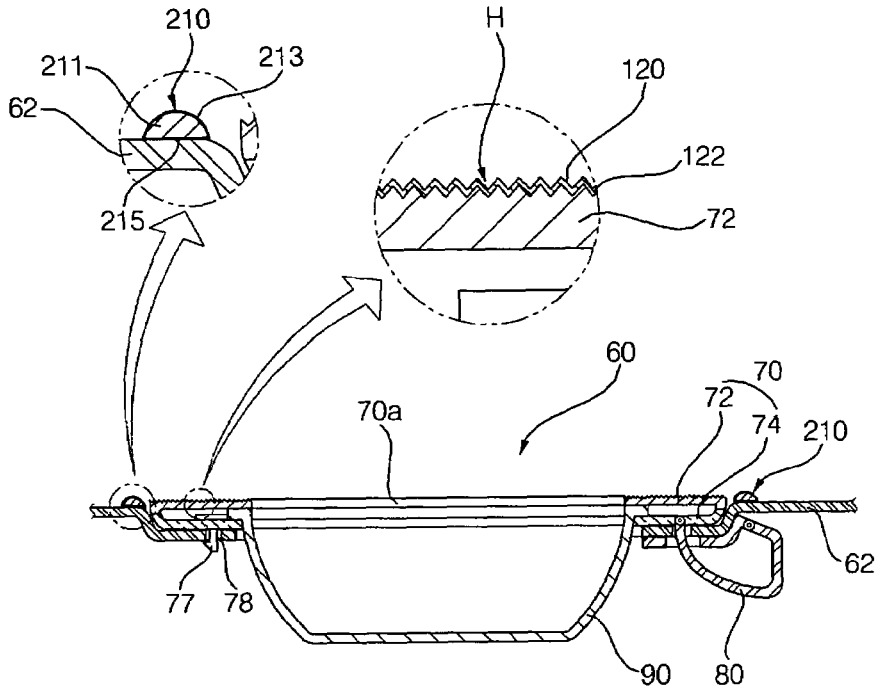
FIG. 8 is a cross-sectional view showing a door and a door ring of the drum type washing machine according to a second preferred embodiment of the present invention.

FIG. 8 is a cross-sectional view showing a door and a door ring of the drum type washing machine according to a second preferred embodiment of the present invention. Components of the drum type washing machine according to the second preferred embodiment of the present invention, which are identical or similar in construction to those of the drum type washing machine according to the first preferred embodiment of the present invention, are indicated by the same reference numerals as those of the drum type washing machine according to the first preferred embodiment of the present invention, and a detailed description thereof will not be given.

As shown in FIG. 8, the drum type washing machine according to the second preferred embodiment of the present invention is characterized in that a decorative part 120, which is plated with a metallic material, is integrally formed at the front surface of the door frame 70 and that a door ring 210 is attached to the front surface of the cabinet cover 62. Other components of the drum type washing machine according to the second preferred embodiment of the present invention are identical or similar in construction to those of the drum type washing machine according to the first preferred embodiment of the present invention.

Specifically, the decorative part 120 consists of multiple ring-shaped hairlines H, which are formed at the front surface of the front door frame 72. The decorative part 120 is integrally formed at the front surface of the front door frame 72 when the front door frame 72 is formed by injection molding.

At the surface of the front door frame 72, on which the hairlines H are disposed, is formed a chrome plating layer 122.

The door ring 210 is disposed along the outer circumference of the door 60 in the same fashion as the first preferred embodiment of the present invention. In this embodiment, the door ring 210 is attached to the cabinet cover 62 by means of an adhesive member 215.

At the surface of a ring body 211 of the door ring 210 is formed a metal plating layer 213.

According to the second preferred embodiment of the present invention, the door ring 210 is securely attached to the cabinet cover 62 by means of the adhesive member 215. Consequently, the door ring 210 can be easily and conveniently attached to the cabinet cover 62 without modifying the cabinet cover 62, and therefore, the strength of a structure around the door is increased while the appearance of the structure is improved.

Figure 9:
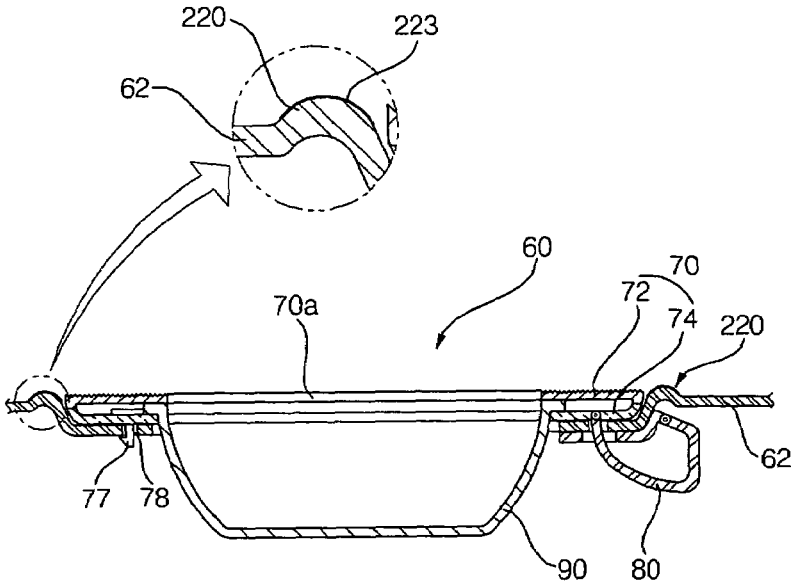
FIG. 9 is a cross-sectional view showing a door and a door ring of the drum type washing machine according to a third preferred embodiment of the present invention.

FIG. 9 is a cross-sectional view showing a door and a door ring of the drum type washing machine according to a third preferred embodiment of the present invention. Components of the drum type washing machine according to the third preferred embodiment of the present invention, which are identical or similar in construction to those of the drum type washing machine according to the first preferred embodiment of the present invention, are indicated by the same reference numerals as those of the drum type washing machine according to the first preferred embodiment of the present invention, and a detailed description thereof will not be given.

The drum type washing machine according to the third preferred embodiment of the present invention is identical in construction to the drum type washing machine according to the third preferred embodiment of the present invention except that a door ring 220 is integrally formed at the cabinet cover 62.

Specifically, the door ring 220 is integrally formed around a predetermined position of the cabinet cover 62 where the door is mounted. The door ring 220 is convexly protruded in the shape of a rib.

At the outer surface of the door ring 220 may be formed a metal plating layer 223.

According to the third preferred embodiment of the present invention, the door ring 220 is integrally formed at the cabinet cover 62. Consequently, the appearance of the door and a structure around the door is improved without attaching an additional member to the cabinet cover 62 while the strength of the structure around the door is increased.

Figure 10:
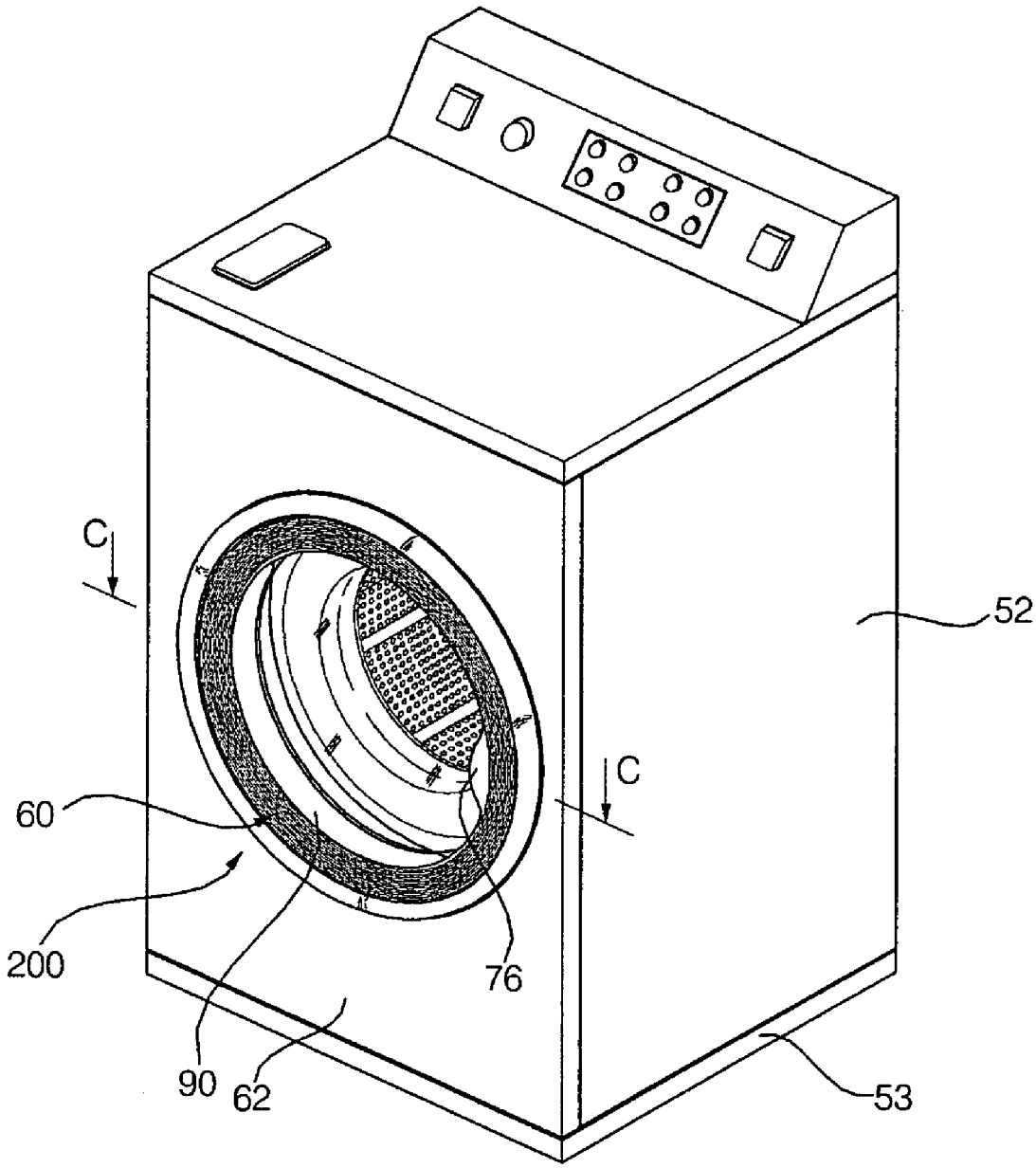
FIG. 10 is a perspective view showing a drum type washing machine with a door ring according to a fourth preferred embodiment of the present invention.
Figure 11:
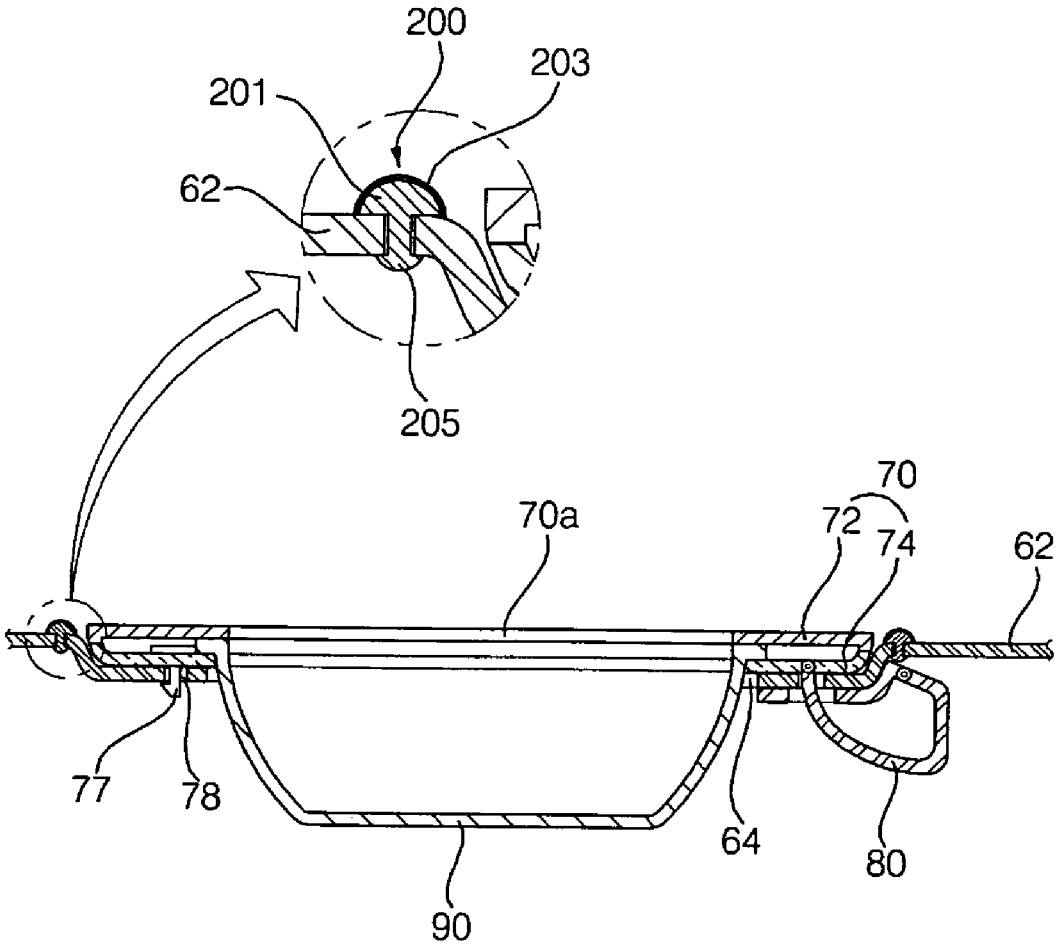
FIG. 11 is a cross-sectional view of the drum type washing machine according to the fourth preferred embodiment of the present invention seen from line C-C of FIG. 10.

FIG. 10 is a perspective view showing a drum type washing machine with a door ring according to a fourth preferred embodiment of the present invention, and FIG. 11 is a cross-sectional view of the drum type washing machine according to the fourth preferred embodiment of the present invention seen from line C-C of FIG. 10.

Components of the drum type washing machine according to the fourth preferred embodiment of the present invention, which are identical or similar in construction to those of the drum type washing machine according to the first preferred embodiment of the present invention, are indicated by the same reference numerals as those of the drum type washing machine according to the first preferred embodiment of the present invention, and a detailed description thereof will not be given.

As shown in FIGS. 10 and 11, the drum type washing machine according to the fourth preferred embodiment of the present invention is characterized in that a decorative part consisting of hairlines is not formed at the door frame 70 and that the door ring 200 is disposed along the outer circumference of the door 60.

The door 60 comprises a front door frame 72, a rear door frame 74, and a door glass 90 disposed between the front door frame 72 and the rear door frame 74.

At the cabinet cover 62, to which the door 60 is hingedly connected, is mounted a door ring 200, which is the same as the first preferred embodiment of the present invention.

Specifically, the door ring 200 comprises: a ring body 210; and a plurality of fixing members 205, which are protruded rearward from the ring body 201. The fixing members 205 of the door ring 200 are inserted in fixing holes 63 formed at the cabinet cover 62, respectively.

Alternatively, the door ring 200 may be attached to the cabinet cover 62 by means of an adhesive member as in the second preferred embodiment of the present invention or may be integrally formed at the cabinet cover 62 as in the third preferred embodiment of the present invention.

According to the fourth preferred embodiment of the present invention, the door ring 200 is disposed around the door 60, and therefore, the strength of a structure around the door is increased while the appearance of the structure around the door is improved.

In the illustrated embodiments, the decorative part consists of hairlines, although the decorative part may consist of other various patterns.

In the illustrated embodiment, the plating layer is formed at the outer surface of the door ring, although a transparent material may be coated at the outer surface of the door ring according to circumstances. Furthermore, various reflective/ nonreflective patterns or embossed/depressed patterns may be formed at the outer surface of the door ring.

As apparent from the above description, the present invention has the following effects.

The front member is attached to the front surface of the door frame. Consequently, the strength of the door frame is considerably increased without forming the door frame of a metallic material or another special material.

Also, the decorative part is formed at the front member of the door frame or is directly formed at the door frame. Consequently, the appearance of the door is improved.

Furthermore, the door ring is mounted at the cabinet around the door. Consequently, the strength of a structure around the door is increased while the appearance of the front surface of the washing machine is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A drum washing machine comprising:

a cabinet having a tub and a drum located therein, the cabinet including a cabinet cover that forms a front of the cabinet, the cabinet cover including an opening;

a door for closing the opening in the cabinet cover, the door including a ring-shaped door frame hingedly connected to the cabinet cover, the door frame including a front door frame and a rear door frame, a door glass supported between the front door frame and the rear door frame, and a front member attached on the front surface of the door frame; and a door ring located at the cabinet cover, the door ring being disposed outside of an outer circumference of the front door frame.

2. The washing machine as set forth in claim 1, wherein the door is formed in the shape of a circle, and the door ring is formed in the shape of a circular ring.

3. The washing machine as set forth in claim 1, wherein the door ring is convexly protruded outward from the cabinet.

4. The washing machine as set forth in claim 1, wherein the door ring has a plating layer formed at the outer surface thereof.

5. The washing machine as set forth in claim 1, wherein the door ring is formed by injection molding.

6. The washing machine as set forth in claim 1, wherein the door ring is securely fixed to the cabinet.

7. The washing machine as set forth in claim 6, wherein the door ring has fixing members, which are formed in the shape of a hook, the fixing members being inserted in fixing holes formed at the cabinet, respectively.

8. The washing machine as set forth in claim 1, wherein the door ring is securely attached to the cabinet by means of an adhesive member.

9. The washing machine as set forth in claim 1, wherein the door ring is integrally formed at the cabinet by bending the cabinet.

10. A drum washing machine comprising:

a cabinet having a tub and a drum located therein, the cabinet including a cabinet cover that forms a front surface of the cabinet, the cabinet cover including an opening;

a door for closing the opening in the cabinet cover, the door including a door frame hingedly connected to the cabinet cover, a groove formed at a front surface of the door frame, a door glass supported by the door frame, and a decorative part securely fitted in the groove of the door frame; and a door ring located at the cabinet cover, the door ring being disposed outside of the outer circumference of the door such that the door does not overlap the door ring when closed, and the door ring being disposed around the opening.

11. The washing machine as set forth in claim 10, wherein the door is formed in the shape of a circle, and the door ring is formed in the shape of a circular ring.

12. The washing machine as set forth in claim 10, wherein the door ring is convexly protruded outward from the cabinet.

13. The washing machine as set forth in claim 10, wherein the door ring has a plating layer formed at the outer surface thereof.

14. The washing machine as set forth in claim 10, wherein the door ring is securely fixed to the cabinet.

15. The washing machine as set forth in claim 10, wherein the door ring is integrally formed at the cabinet by bending the cabinet.

16. A drum washing machine comprising:

a cabinet including a tub and a drum located therein, the cabinet including a cabinet cover that forms a front surface of the cabinet, the cabinet cover including an opening;

a door for closing the opening in the cabinet, the door including a door frame hingedly connected to the cabinet cover and a door glass supported by the door frame; and a door ring located at the cabinet cover, the door ring being disposed around an outer circumference of the door frame and spaced from the opening in the cabinet cover, wherein a fringe of the cabinet cover forming the opening is dented inward from the cabinet cover such that the door frame is positioned on the dented fringe of the cabinet cover when the door is closed, and the door ring is located outside of the dented fringe of the cabinet cover.

17. The washing machine as set forth in claim 16, wherein the door is formed in the shape of a circle, and the door ring is formed in the shape of a circular ring.

18. The washing machine as set forth in claim 16, wherein the door ring is convexly protruded outward from the cabinet.

19. The washing machine as set forth in claim 16, wherein the door ring is securely fixed to the cabinet.

20. The washing machine as set forth in claim 16, wherein the door ring is integrally formed at the cabinet by bending the cabinet.

* * * * *